United States Patent [19]

DeBlende

[11] 4,386,875

[45] Jun. 7, 1983

[54] APPARATUS TO SUPPORT A FRAME OF CASING ELEMENT FOR FORMING A BEAM ON A PILE-PLANK SCREEN

[76] Inventor: Remi DeBlende, Zijdijk, 1A, Grembergen, Belgium

[21] Appl. No.: 298,644

[22] Filed: Sep. 2, 1981

Related U.S. Application Data

[63] Continuation of Ser. No. 96,405, Nov. 21, 1979, abandoned.

[51] Int. Cl.[3] ..... E02D 5/00

[52] U.S. Cl. ..... 405/229; 52/293; 249/50; 249/210; 405/273; 405/284

[58] Field of Search ..... 405/229, 230, 274, 275, 405/276, 287; 52/292–296, 300, 301; 249/28, 29, 19, 50, 49, 219, 207, 210; 404/2, 3

[56] References Cited

U.S. PATENT DOCUMENTS

| | | | |
|---|---|---|---|
| 857,524 | 6/1907 | Hindman et al. | 249/29 |
| 1,006,247 | 10/1911 | Martin | 405/287 |
| 1,048,567 | 12/1912 | Miller | 405/275 |
| 1,470,673 | 10/1923 | Ambursen | 249/28 |
| 1,556,653 | 10/1925 | Watson | 405/274 |
| 1,842,683 | 1/1932 | Markham | 249/210 X |
| 2,941,371 | 6/1960 | Benedict et al. | 52/300 X |
| 3,063,122 | 11/1962 | Katz | 249/50 |
| 3,226,935 | 1/1966 | Schneller | 405/287 |
| 3,416,277 | 12/1968 | Wood et al. | 52/300 |
| 3,750,197 | 8/1973 | Weir et al. | 52/293 X |

*Primary Examiner*—Dennis L. Taylor

*Attorney, Agent, or Firm*—Laff, Whitesel, Conte & Saret

[57] ABSTRACT

Apparatus to bear the coffering for the pouring of concrete up or against profiled piles used for waterworks, for the reinforcement of steep banks, quay walls, ducdalves etc. The poured concrete is beared by a coffering support composed of a component pinched horizontally and laterally in a rigid way in the notches of the profiled piles and this longitudinally to the curtain of sunken piles.

5 Claims, 5 Drawing Figures

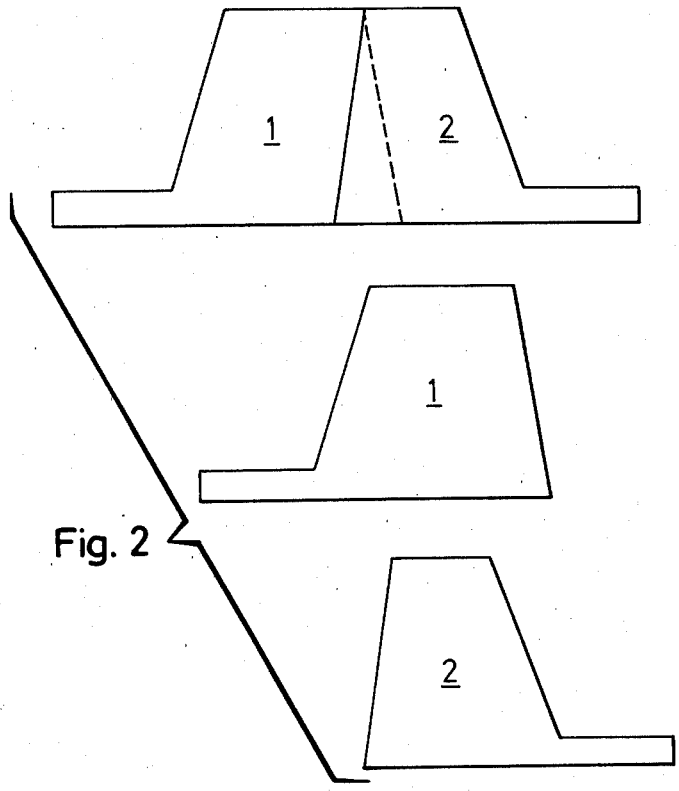
Fig. 2
Fig. 3
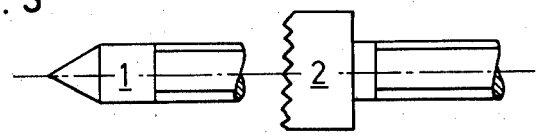

APPARATUS TO SUPPORT A FRAME OF CASING ELEMENT FOR FORMING A BEAM ON A PILE-PLANK SCREEN

This is a continuation of my pending application Ser. No. 096,405, filed Nov. 21, 1979, now abandoned.

The present invention relates to apparatus for supporting a frame or casing element which makes a form that receives poured concrete in order to cast a beam, with the wet cement resting against or upon the upper surface of a pile-plank wall or flooring.

According to a generally used prior art technique, the formation of a beam against the upper part of a pile-plank flooring or on each side of a pile-plank wall is done by using casing parts which are inserted into a depressions between the upstanding wings or sidewalls of the U-shaped cross-section of pile-planks. Whether made of wood or of metal, the supports for those casing elements must be inserted between the vertical walls of the U-shaped cross-section of the pile-planks.

This prior art technique causes a substantial and important waste of material and requires an appreciable amount of labor. It was not only necessary to weld the supporting parts but also it was necessary to cut them out, with a blow torch or welders torch, at a later time when they are removed from the pile-planks. In order to support such conventional prior art casing, it is thus necessary to weld a very large number of parts either at right angles to each other, or at some other profiles. These parts are usually welded in either the depressions or on the elevations of the pile-planks. When working according to such a technique, very often an important part of the wood casing may have to be destroyed during the removal of the casing from the completed beam after the concrete has set-up.

Accordingly, an object of present invention is to remedy that drawback and to provide apparatus for supporting the casing elements for constructing a beam of the above-described type.

According to an aspect of the present invention, a part or member which can be blocked laterally is positioned in a depression between the upstanding wings or sidewalls of the U-shaped cross-section of a pile-plank. At least one of these blocking means is laterally movable, relative to the member. Advantageously, the laterally movable block has at least one cone-shaped lateral projection which makes contact with and bears against a wall of said pile-planking. On at least the opposite side of the lateral projection, a spindle with a cone-shaped end may be axially displaced and firmly applied against the wall of the corresponding wing or sidewall of the pile-plank.

In one and a preferred embodiment, the apparatus according to the present invention presents an arm which is directed downwardly when in use, in order to take its support from the underlying pile-plank. When the aforementioned arm member is laterally blocked in the depression between the wings or sidewalls of a pile-plank, it tends to swing around the geometric axis of the spindle. Therefore, a supporting bracket is also included.

Other details and advantages of the invention will be seen from the description which is given below, of a preferred embodiment to support a casing element, according to the invention, that description is given only by way of example and in connection with the attached Figures, in which:

FIG. 2 is an elevation view which shows two pile-planks each of which is assembled and equipped with an apparatus according to the invention;

FIG. 3 shows elements of a casing, considered both separately and assembled, which elements come to rest on the support-forming member, in the apparatus according to the invention;

FIG. 4 shows a cone-shaped end of a spindle used to block the apparatus in a depression, between the wings of a pile-plank; and FIG. 5 shows a variation of a spindle for performing essentially the same blocking function.

Figure 1:
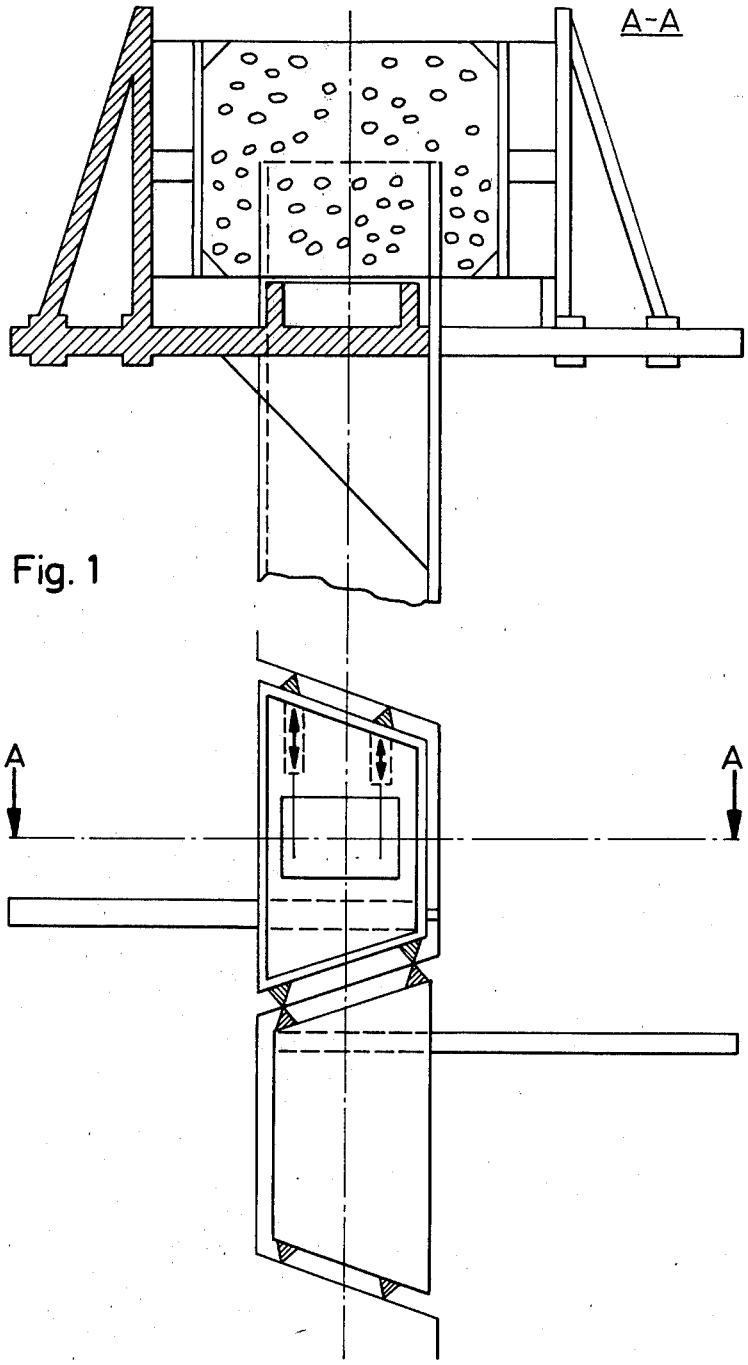
FIG. 1 is a cross section view of a coffer form with cement therein, the figure being taken along line I—I in FIG. 2.

The apparatus according to the invention essentially comprises a member 1 which (in the embodiment of FIGS. 1 and 2) presents the shape of a somewhat widely flaring "U". That member is blocked between upstanding wings or sidewalls 2' (FIG. 2) of the U-shaped cross-section of pile-planks 2.

The pile-planks may have various (FIG. 2) cross-sectional shapes; or they may be formed from a variety of corner pieces having different shapes. When walls or floors are built of pile-planks, wings 2' form depressions and elevations or projections.

In each depression formed by the succession of the pile-planks, member 1 comes to fit with the form of the widely flaring U-shaped cross-section. Member 1 is here shown as being mounted in a position of use, in a horizontal plane on the wall of the pile-planks, which is here considered, by way of example, as being vertical.

A plurality of the members 1 may be blocked in various manners between wings or sidewalls 2' of pile-planks 2. In the embodiment described in FIG. 2, there are two spindles 3 and 4, each having a conical end as at 5 and 6 (respectively). Opposite the conical ends 5 and 6 of member 1, there are other conical projections 7 and 8.

In order to block and secure member 1 between wings or sidewalls 2' of a pile-plank 2, it is sufficient to manually, mechanically, pneumatically, or the like, for example, to adjust the axial displacement of the spindles with the conical ends, as schematically represented by a double ended arrow. Those spindles are manipulated to firmly press the conical tips 5 and 6 against and into the wall of the corresponding wing 2 of the pile-plank. This manipulation is accomplished by maneuvering or adjusting levers 9 into position, in a vertical plane via an opening 10, which is provided in the base of member 1.

Further, an arm 11 is, for example, welded to member 1. The arm 11 extends in a horizontal plane when in a position of use, as represented in FIG. 1. Arm 11 has a second arm 12, which may take on the shape of a square or a second member which laterally supports the vertical elements 13 of the form casing in which a concrete beam 14 is poured.

Elements 15 and 16 provide the floor or lower part of the casing in which concrete beam 14 is formed. These elements 15 and 16 rest on member 1, which has a shape seen in plane view, that corresponds to the depression within the U-shaped cross-section of a pile-plank. Those casing elements 15 and 16 may be made of either wood or metal, and thus they can easily be removed and recovered when the beam 14 is freed from the casing.

Arms 12 are preferably made so that they can slide along arm 11, in order to easily fit the desired width for beam 14. (That is arms 12, 12 slide left and right as viewed in FIG. 1).

Means, well known in themselves, such as corner pieces for example, make it possible to immobilize arms 12, relative to arms 11, which, for their part, always are horizontal when in the position of use.

When only one conically ended spindle (e.g., 3) is used, to cooperate with one projection (e.g., 8), member 11 is blocked by only one cone-shaped end 5 in cooperation with a cone-shaped projection 8 or by one cone-shaped end 6 in cooperation with a cone-shaped lateral projection 7. Thus, it appears that member 1 could swing around the geometric axis of each one of the spindles 3 or 4.

In order to prevent such a swinging, a square 17 is provided under arm 11 to rest against a lateral wall of pile-planks 2 when member 1 is in use under the casing supporting member.

When only one blocking spindle is used in cooperation with a conical lateral projection which is placed in the same geometric axis, the spindle is obviously and preferably located in the axis of symmetry of member 1.

FIGS. 4 and 5 show two spindle ends. The first spindle (FIG. 4) has a cone-shaped end 18' on a spindle 18, and the second spindle (FIG. 5) has an indented or serrated end piece 19' on a spindle 19. The indented or serrated part 19' is used when the lateral wing of the pile-plank extends at or almost at a right angle, relative to the plane of the wall or screen of pile-planks.

It is obvious that the present invention is not limited to the embodiments which have been described above, and that numerous modifications could be made in them, without leaving the scope of the invention.

I claim:

1. An apparatus for supporting a casing form for casting concrete into a beam, said apparatus resting against or being supported by the upper surface of a wall or flooring of pile-planks, each of said pile-planks having a flaring U-shaped cross-section, said apparatus comprising member means for laterally blocking a depression between upstanding wings or sidewalls of the U-shaped cross-section of a pile-plank, and means for securing said member means, while in said U-shaped cross-section, said member means being mounted transversely for blocking off at least the U-shaped cross-section while said securing means locks said member means against lateral movement relative to said pile-planking.

2. The apparatus according to claim 1 wherein said securing means is positioned to laterally block and position the member means within the depression between the two wings of U-shaped cross-section pile-plank, means comprising at least one conical lateral projection and at least one opposite conical projection, and spindle means with a conical end which is axially movable to apply a firm pressure against a wall of a corresponding wing of the pile-plank.

3. The apparatus according to one of the claims 1 or 2, wherein said member means further comprises an arm means which is directed downwardly from a position of use to take its support against underlying pile-plank when said member means in the depression between the wings of a pile-plank, said arm precluding a swinging of said member means around a geometric axis of the spindle.

4. The apparatus according to claim 3, wherein said member means is laterally blocked in the depression between the wings of said pile-plank by said arm which is directed upwardly to hold a vertical casing element.

5. The apparatus according to claim 4, said arm for holding a vertical casing element being mounted on means for sliding horizontally in a profile to a position of use.

* * * * *